US006283473B1

(12) United States Patent
Abramopoulos et al.

(10) Patent No.: US 6,283,473 B1
(45) Date of Patent: Sep. 4, 2001

(54) METHOD OF OPERATING PROGRESSIVE REEL SLOT MACHINES AND DEVICE THEREFOR

(76) Inventors: Frank Abramopoulos, 2373 Broadway, Apt. 1126, New York, NY (US) 10024; Jennifer Spano, 217 W. 16th St., Apt. C, New York, NY (US) 10011

( * ) Notice: Subject to any disclaimer, the term of this patent is extended or adjusted under 35 U.S.C. 154(b) by 0 days.

(21) Appl. No.: 09/196,418

(22) Filed: Nov. 19, 1998

(51) Int. Cl.[7] ..... A63B 71/00

(52) U.S. Cl. ..... 273/148 R; 463/47; 463/1; 235/70 A; 235/61 G

(58) Field of Search ..... 273/148 R; 463/47, 463/16, 17, 18, 19, 20, 25, 26, 27; 700/90, 91, 92; 235/61 G, 70 A, 79.5, 84

(56) References Cited

U.S. PATENT DOCUMENTS

| | | | | |
|---|---|---|---|---|
| D. 316,868 | | 5/1991 | Johnson . | |
| D. 383,774 | | 9/1997 | Winn . | |
| 1,907,677 | | 5/1933 | Schroeder et al. . | |
| 2,532,619 | | 12/1950 | Heerich . | |
| 3,568,922 | | 3/1971 | Pepper . | |
| 3,825,180 | * | 7/1974 | Gallagher | 235/89 |
| 3,902,656 | | 9/1975 | Rothchild . | |
| 3,999,041 | * | 12/1976 | Scofield | 235/61 G |
| 4,132,348 | | 1/1979 | Bromberg . | |
| 4,149,068 | | 4/1979 | Simon . | |
| 4,233,768 | | 11/1980 | Bromberg . | |
| 4,308,449 | * | 12/1981 | Kelley | 235/70 |
| 4,310,750 | * | 1/1982 | Kelley | 235/70 |
| 4,425,499 | | 1/1984 | Newton . | |
| 4,454,410 | | 6/1984 | Merl . | |
| 4,564,750 | | 1/1986 | Olsen . | |
| 5,449,890 | | 9/1995 | van Neck . | |
| 5,769,417 | * | 6/1998 | Richer et al. | 273/148 R |

OTHER PUBLICATIONS

Crevelt, Dwight, et al., Video Poker Mania!!, 1991, Chapter 3: Poker Percentages, pp. 49–76.

* cited by examiner

*Primary Examiner*—J. Harrison
(74) *Attorney, Agent, or Firm*—Schweitzer Cornman Gross & Bondell LLP

(57) ABSTRACT

A method of increasing gaming activity and entertainment value of progressive reel slot machines involving providing a progressive reel slot machine, publishing certain critical parameters, and providing a means or an equation to allow players to calculate the current expected progressive return of the machine thereby increasing the attraction and interactivity of progressive reel slot machines. The published critical parameters are the probability of hitting the progressive jackpot, the current amount of the progressive jackpot, the amount of the qualifying bet, and either the truncated return of the machine, or the flat return of the machine and the amount of the minimum reset value of the progressive reel slot machine. The critical parameters can be presented in raw or encoded form and can be published on the individual machines. A pre-programmed electronic calculator can be provided to calculate the current expected progressive return upon input of the published critical parameters, or a slide rule calculator can be provided which is designed to calculate the return for various progressive reel slot machines.

19 Claims, 5 Drawing Sheets

FIG. 1

32

16 10 18

| | | | | | |
|---|---|---|---|---|---|
| 86.0 % | 87.0 % | 88.0 % | 89.0 % | 90.0 % | 91.0 % |
| 86.0 % | 87.0 % | 88.0 % | 89.0 % | 90.0 % | 91.0 % |
| 86.0 % | 87.0 % | 88.0 % | 89.0 % | 90.0 % | 91.0 % |
| 86.0 % | 87.0 % | 88.0 % | 89.0 % | 90.0 % | 91.0 % |
| 86.0 % | 87.0 % | 88.0 % | 89.0 % | 90.0 % | 91.0 % |
| 86.0 % | 87.0 % | 88.0 % | 89.0 % | 90.0 % | 91.0 % |
| 86.0 % | 87.0 % | 88.0 % | 89.0 % | 90.0 % | 91.0 % |
| 86.0 % | 87.0 % | 88.0 % | 89.0 % | 90.0 % | 91.0 % |
| 86.0 % | 87.0 % | 88.0 % | 89.0 % | 90.0 % | 91.0 % |
| 86.0 % | 87.0 % | 88.0 % | 89.0 % | 90.0 % | 91.0 % |
| 86.0 % | 87.0 % | 88.0 % | 89.0 % | 90.0 % | 91.0 % |
| 86.0 % | 87.0 % | 88.0 % | 89.0 % | 90.0 % | 91.0 % |
| 86.0 % | 87.0 % | 88.0 % | 89.0 % | 90.0 % | 91.0 % |
| 86.0 % | 87.0 % | 88.0 % | 89.0 % | 90.0 % | 91.0 % |
| 86.0 % | 87.0 % | 88.0 % | 89.0 % | 90.0 % | 91.0 % |
| 86.0 % | 87.0 % | 88.0 % | 89.0 % | 90.0 % | 91.0 % |
| 86.1 % | 87.1 % | 88.1 % | 89.1 % | 90.1 % | 91.1 % |
| 86.1 % | 87.1 % | 88.1 % | 89.1 % | 90.1 % | 91.1 % |
| 86.1 % | 87.1 % | 88.1 % | 89.1 % | 90.1 % | 91.1 % |
| 86.1 % | 87.1 % | 88.1 % | 89.1 % | 90.1 % | 91.1 % |
| 86.1 % | 87.1 % | 88.1 % | 89.1 % | 90.1 % | 91.1 % |
| 86.2 % | 87.2 % | 88.2 % | 89.2 % | 90.2 % | 91.2 % |
| 86.2 % | 87.2 % | 88.2 % | 89.2 % | 90.2 % | 91.2 % |
| 86.3 % | 87.3 % | 88.3 % | 89.3 % | 90.3 % | 91.3 % |
| 86.3 % | 87.3 % | 88.3 % | 89.3 % | 90.3 % | 91.3 % |
| 86.4 % | 87.4 % | 88.4 % | 89.4 % | 90.4 % | 91.4 % |
| 86.5 % | 87.5 % | 88.5 % | 89.5 % | 90.5 % | 91.5 % |
| 86.6 % | 87.6 % | 88.6 % | 89.6 % | 90.6 % | 91.6 % |
| 86.8 % | 87.8 % | 88.8 % | 89.8 % | 90.8 % | 91.8 % |
| 87.0 % | 88.0 % | 89.0 % | 90.0 % | 91.0 % | 92.0 % |
| 87.3 % | 88.3 % | 89.3 % | 90.3 % | 91.3 % | 92.3 % |
| 87.6 % | 88.6 % | 89.6 % | 90.6 % | 91.6 % | 92.6 % |
| 88.0 % | 89.0 % | 90.0 % | 91.0 % | 92.0 % | 93.0 % |
| 88.5 % | 89.5 % | 90.5 % | 91.5 % | 92.5 % | 93.5 % |
| 89.2 % | 90.2 % | 91.2 % | 92.2 % | 93.2 % | 94.2 % |
| 90.0 % | 91.0 % | 92.0 % | 93.0 % | 94.0 % | 95.0 % |
| 91.0 % | 92.0 % | 93.0 % | 94.0 % | 95.0 % | 96.0 % |
| 92.3 % | 93.3 % | 94.3 % | 95.3 % | 96.3 % | 97.3 % |
| 93.9 % | 94.9 % | 95.9 % | 96.9 % | 97.9 % | 98.9 % |
| 96.0 % | 97.0 % | 98.0 % | 99.0 % | 100.0 % | 101.0 % |
| 98.5 % | 99.6 % | 100.6 % | 101.6 % | 102.6 % | 103.6 % |
| 101.8 % | 102.8 % | 103.8 % | 104.8 % | 105.8 % | 106.8 % |
| 106.0 % | 107.0 % | 108.0 % | 109.0 % | 110.0 % | 111.0 % |
| 111.1 % | 112.1 % | 113.1 % | 114.1 % | 115.1 % | 116.1 % |
| 117.6 % | 118.6 % | 119.6 % | 120.6 % | 121.6 % | 122.6 % |
| 125.8 % | 126.8 % | 127.8 % | 128.8 % | 129.8 % | 130.8 % |
| 136.1 % | 137.1 % | 138.1 % | 139.1 % | 140.1 % | 141.1 % |
| 149.1 % | 150.1 % | 151.1 % | 152.1 % | 153.1 % | 154.1 % |
| 165.4 % | 166.4 % | 167.4 % | 168.4 % | 169.4 % | 170.4 % |
| 186.0 % | 187.0 % | 188.0 % | 189.0 % | 190.0 % | 191.0 % |

METHOD OF OPERATING PROGRESSIVE REEL SLOT MACHINES AND DEVICE THEREFOR

FIELD OF THE INVENTION

This invention pertains to the field of progressive gaming machines, and in particular to the operation of progressive reel slot machines.

BACKGROUND OF THE INVENTION

Gaming machines, and "reel" slot machines in particular, have been an important, profitable and entertaining part of the gaming industry since its inception. The profitability of a gaming machine is partly determined by the "return" of the machine, which, from a casino's (or other operator's) perspective is typically fixed. Therefore, to increase profits, a commercial gaming machine operator usually must increase the amount of gaming activity (or "handle") its machines attract. Operators have found that increasing the attraction of and interaction with gaming machines, as well as the entertainment value of the gaming machines, increases gaming activity. Thus, operators are continually striving, and competing with one another, to increase the attraction, interactivity and entertainment value of their gaming machines, including progressive reel slot machines.

Therefore, what is desired is a method of increasing the attraction and interactivity of progressive reel slot machines to thereby increase the entertainment value and gaming activity associated with the progressive reel slot machines.

SUMMARY OF THE INVENTION

Reel slot machines are distinguished from other gaming machines with coin "slots" in that reel slot machines have a number of physical (or sometimes video) spinning reels with symbols (e.g., diamonds, oranges, etc.). Reel slot machines have a number of predetermined winning combinations which payout a certain amount when the combination appears on the "pay line"(most commonly), expressed as a multiple of the qualifying bet D. Typically there is a "jackpot" winning combination and several lesser-paying winning combinations. The probabilities of hitting the jackpot and the lesser-paying winning combinations are fixed. The probability of hitting a lower-paying winning combination is greater than the probability of hitting a higher-paying winning combination. As will be explained further below, the "expected return" to the player of a reel slot machine having a predetermined jackpot amount is fixed.

The jackpot of a progressive reel slot machine increases with the amount of play the machine has received since the last payout of the progressive jackpot. Typically, the progressive jackpot is increased by a relatively small percentage of each bet (e.g., 1%). This is called the "progressive increment". The probability of hitting the progressive jackpot is fixed and is determined by the manufacturer or operator of the machine. However, as will be explained in detail below, from a mathematical standpoint the "current expected return" (from the player's perspective) of the progressive reel slot machine increases as the progressive jackpot increases. However, the player has no means to determine the return. The return of a progressive reel slot machine can be calculated if all of the critical parameters are known (such as the probability of hitting the progressive jackpot). However, casinos and other operators of progressive reel slot machines closely guard such information.

The invention comprises a method of operating progressive reel slot machines which allows players to determine the current expected progressive return of a given machine so that they can choose which machine they wish to play. Players will be attracted to such machines because they will be able to determine the current expected progressive return. The steps involved in determining the current expected progressive return will increase the interactivity of the players with the gaming machines. The process will entertain the players because they will have an active role in determining the return they receive for their bet.

Since the return of the progressive reel slot machine, from the operator's perspective, is fixed and does not change with respect to the amount of the progressive jackpot, the operator is not concerned with which machine, out of a group of its otherwise equivalent progressive reel slot machines, is played. The operator benefits by the increase in traffic and the overall increase in play of the group of machines. The player benefits by being able to choose his/her expected return and by the increase in entertainment value of the gaming machine.

In practice, the method involves publishing (or posting), preferably on the machine itself, information to allow the player to calculate the current expected return of the machine. The amount of the progressive jackpot is typically displayed on the machine. In addition, the qualifying or "maximum" bet required to qualify for the progressive jackpot is typically shown on the machine. The additional information required to determine the current expected progressive return of the machine is: (1) the probability of hitting the progressive jackpot, and (2) either (a) the "truncated return" of the slot machine (defined in the detailed description of the invention), or (b) the "flat return" of the slot machine (also defined below) and the minimum "reset" value of the progressive jackpot. These numbers (collectively referred to as the "critical parameters") can be combined and/or encoded to limit the disclosure of the critical parameters of the machine, or can be in "raw" form. The players are provided with a device to calculate the current expected progressive return based on the published critical parameters.

BRIEF DESCRIPTION OF THE DRAWINGS

For a complete understanding of the above and other features of the invention, reference shall be made to the following detailed description of the preferred embodiments of the invention and to the accompanying drawings, wherein:

FIG. 1 is a top plan view of the card member of the slide rule calculator;

DETAILED DESCRIPTION OF THE INVENTION

Figure 2:
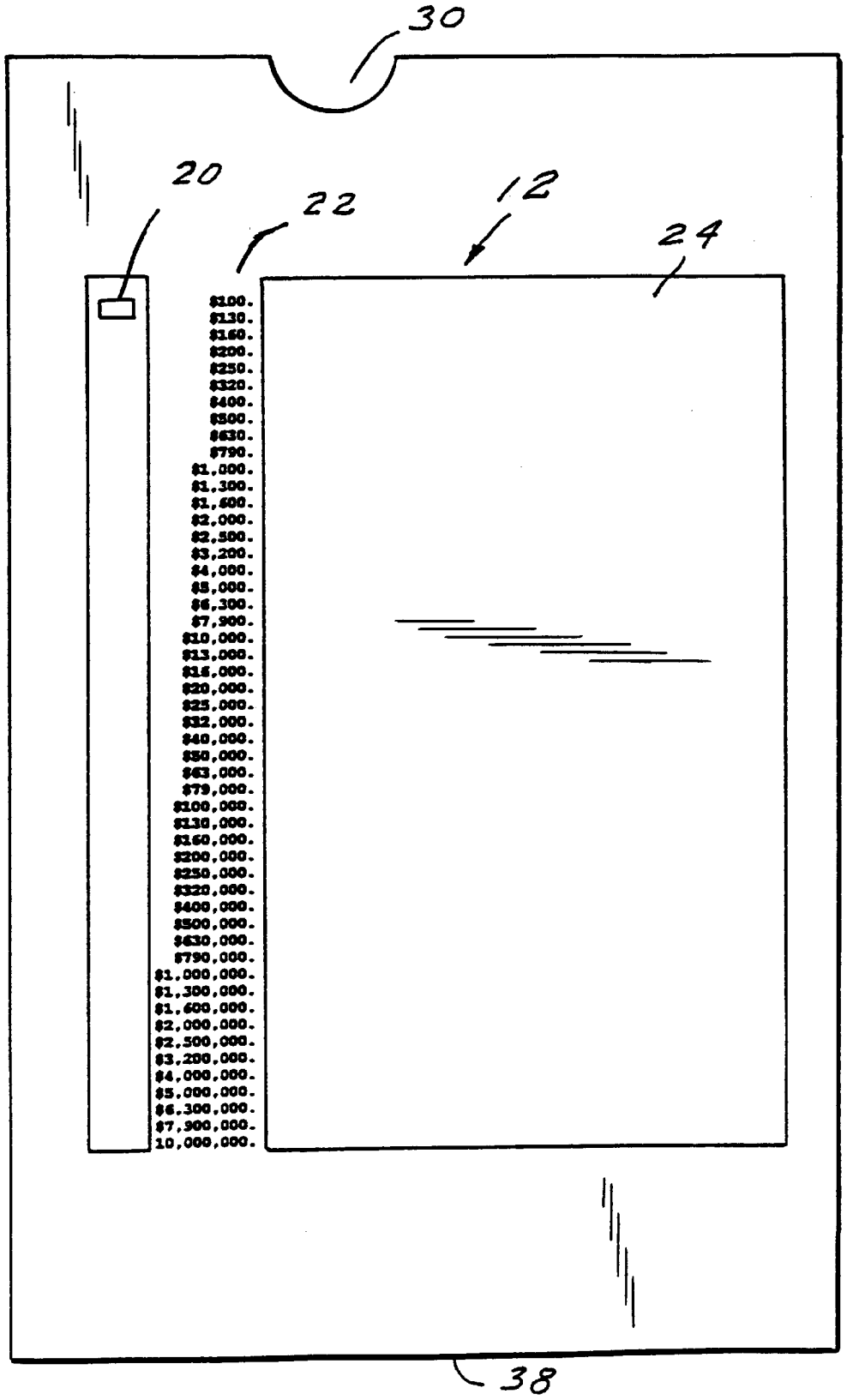
FIG. 2 is a top plan view of the middle sleeve of the slide rule calculator.
Figure 3:
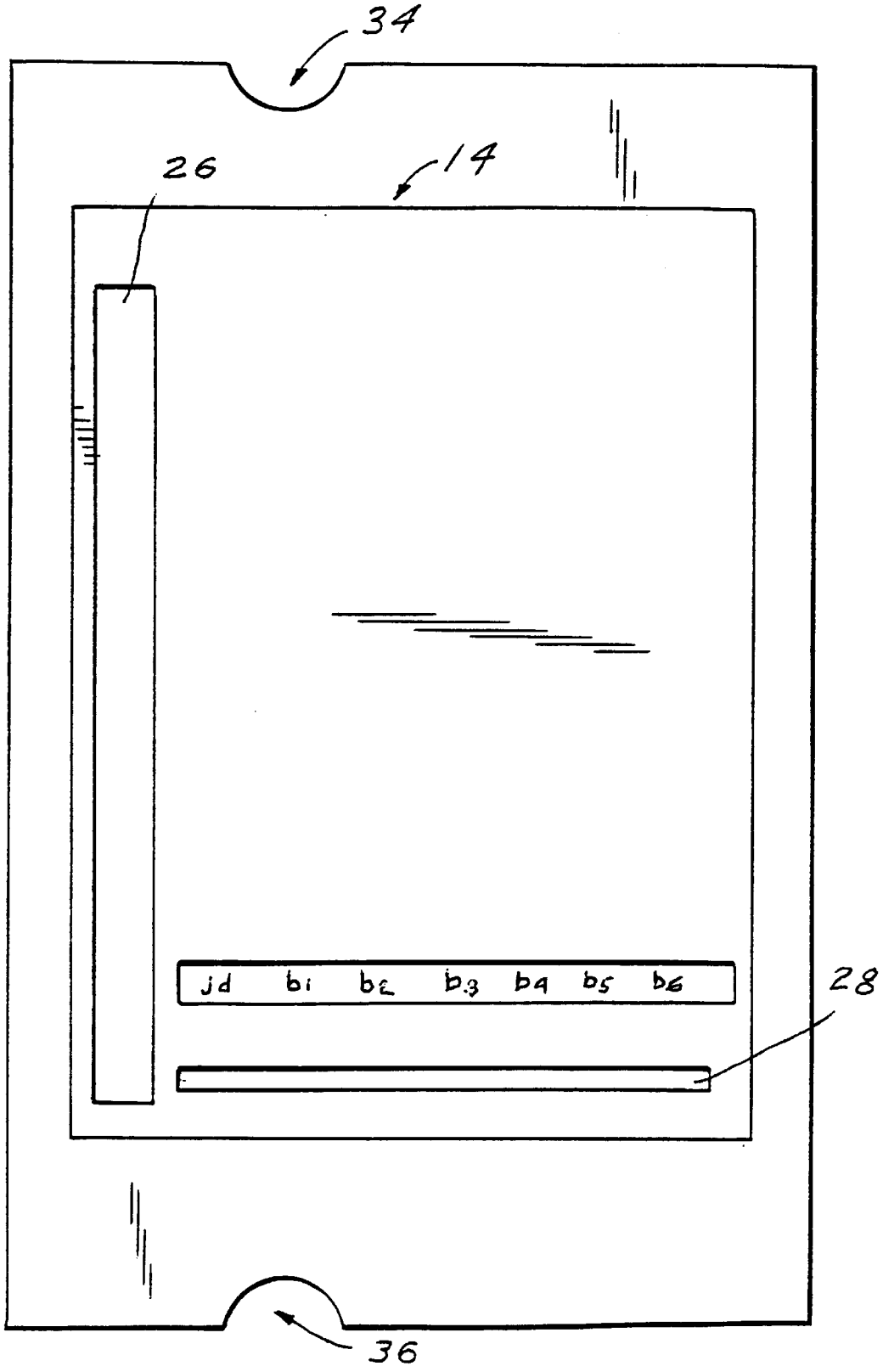
FIG. 3 is a top plan view of the outer sleeve of the slide rule calculator.

The expected return (from the player's perspective) of a "flat" (i.e., non-progressive) reel slot machine can be calculated if the probabilities and payouts of all the winning combinations are known. Since the probabilities and payouts are fixed, the expected return of a flat reel slot machine is fixed. In mathematical terms, the expected return $R_{Flat}$ of a flat reel slot machine can be expressed as:

$$R_{Flat} = \sum_{i=1}^{n} p_i w_i \quad [1]$$

where $R_{Flat}$ is the expected return of the flat reel slot machine, expressed as a percentage;

$p_i$ is the probability of hitting the ith winning combination, expressed as a percentage;

$w_i$ is the payout for hitting the ith winning combination, expressed as a multiple of the bet; and n is the number of winning combinations.

The return of a flat reel slot machine as viewed from the operator's perspective is the same as that viewed from the player's perspective. Also, the returns and probabilities are intended to be expressed as percentages, throughout this disclosure. However, it can be appreciated that returns and probabilities can be expressed in decimal form.

The current expected return of a progressive reel slot machine, from the player's perspective, $R_{Prog(P)}$ varies depending on the current amount of the progressive jackpot. Therefore, this value is stated as the current expected progressive return. Using the above formula if $w_1$ is replaced by the amount of the current progressive Jackpot $J_p$, and $p_1$ is replaced by the probability of hitting the progressive jackpot $\alpha$, then the current expected progressive return $R_{Prog(P)}$ of a progressive reel slot machine (from the player's perspective) can be expressed as:

$$R_{Prog(P)} = \alpha J_p + \sum_{i=2}^{n} p_i w_i \quad [2]$$

where $R_{Prog(P)}$ is the current expected progressive return of a progressive reel slot machine, from the player's perspective;

$\alpha$ is the probability of hitting the progressive jackpot, expressed as a percentage;

$J_p$ is the current amount of the progressive jackpot, expressed as a multiple of the qualifying bet D;

$p_i$ is the probability of hitting the ith winning combination, expressed as a percentage;

$w_i$ is the payout for hitting the ith winning combination, expressed as a multiple of the qualifying bet D; and n is the total number of winning combinations (including the jackpot).

The second term of the above equation [2] (i.e., $\Sigma p_i w_i$, i=2 to n), is herein referred to as the "truncated return", or $R_T$. That is, the return of the progressive reel slot machine without regard to the progressive jackpot. It can be appreciated that the "truncated return" $R_T$ of the progressive reel slot machine is fixed and does not depend on the amount of the progressive jackpot. Thus, the current expected progressive return $R_{Prog(P)}$ can be expressed as:

$$R_{Prog(P)}=\alpha J_p+R_T \quad [3]$$

where $R_{Prog(P)}$ is the current expected progressive return of a progressive reel slot machine, from the player's perspective;

$\alpha$ is the probability of hitting the progressive jackpot, expressed as a percentage;

$J_p$ is the current amount of the progressive jackpot, expressed as a multiple of the qualifying bet D; and $R_T$ is the truncated return as defined with respect to equation [2].

The current expected progressive return, from the player's perspective, of a progressive reel slot machine $R_{Prog(P)}$ can also be expressed as:

$$R_{Prog(P)}=mJ_d+R_T \quad [4]$$

where $R_{Prog(P)}$ is the current expected progressive return of a progressive reel slot machine, from the player's perspective;

m is the probability of hitting the progressive jackpot $\alpha$ (expressed as a percentage) divided by the amount of the qualifying bet D;

$J_d$ is the current amount of the progressive jackpot, in, e.g., dollars; and $R_T$ is the truncated return, as defined above with respect to equation [2].

The term "flat return" $R_o$ will be used herein to mean the return of the progressive reel slot machine, from the player's perspective, when the jackpot is at the reset (or minimum) value $J_o$. Thus the flat return $R_o$ can be expressed as:

$$R_o=\alpha J_o+R_T \quad [5]$$

where $R_o$ is the flat return of a progressive reel slot machine;

$\alpha$ is the probability of hitting the jackpot, expressed as a percentage;

$J_o$ is the amount of the reset value of the jackpot; and $R_T$ is the truncated return as defined in with respect to equation [2].

Using equations [3] and [5], the current expected progressive return $R_{Prog(P)}$, from the player's perspective, can be expressed using the flat return $R_o$, as:

$$R_{Prog(P)}=\alpha(J_p-J_o)+R_o \quad [6]$$

where $R_{Prog(P)}$ is the current expected progressive return of a progressive reel slot machine, from the player's perspective;

$\alpha$ is the probability of hitting the progressive jackpot, expressed as a percentage;

$J_p$ is the current amount of the progressive jackpot, expressed as a multiple of the qualifying bet D;

$J_o$ is the amount of the reset value of the jackpot; and $R_o$ is the flat return as defined in equation [5].

Given the above formulas [3], [4] or [6], the current expected progressive return of a progressive reel slot machine at any given point in time can be determined by knowing: (1) the probability of hitting the progressive jackpot, (2) the amount of the progressive jackpot, (3) the amount of the qualifying bet, and (4) either (a) the "truncated return" of the progressive reel slot machine, or (b) the "flat return" and the reset amount of the jackpot. However, casinos and other operators of progressive reel slot machines have heretofore had a strict policy of not disclosing such information.

The return of a progressive reel slot machine, as viewed from an operator's perspective, is not the same as that viewed from a player's perspective. The expected progressive return, from an operator's perspective is fixed. This is because operators consider the money contributed to and accumulated in the progressive jackpot to be the "player's money". Thus, the expected return of a progressive reel slot machine, from an operator's perspective, $R_{Prog(O)}$, is equal to the flat return of the machine $R_o$, plus the progressive increment u (referred to in the Background of the Invention), which can be expressed as:

$$R_{Prog(O)}=R_o+u; \quad [7]$$

where $R_{Prog(O)}$ is the expected return of a progressive reel slot machine, from an operator's perspective;

$R_o$ is the flat return; and u is the progressive increment.

It can be appreciated that since the flat return of the progressive reel slot machine $R_o$ and the progressive increment u are fixed, then the expected return of a progressive reel slot machine, from an operator's perspective, $R_{Prog(O)}$, is also fixed. Thus, the expected progressive return, from an operator's perspective, does not depend on the amount of the progressive jackpot. Therefore, an operator is not concerned with which particular machine a player chooses from its group of otherwise equivalent machines. An operator is concerned with increasing the overall amount of total gaming activity (or "handle") that the group of machines attract. The operator can increase gaming activity by increasing the attraction, interaction and entertainment value of the progressive slot machines by providing the critical parameters and a means to determine the current expected progressive return, from the player's perspective.

The invention comprises posting or publishing, preferably on the progressive reel slot machine itself, information related to the following critical parameters: (1) the probability of hitting the progressive jackpot, (2) the amount of the progressive jackpot, (3) the amount of the qualifying bet, and (4) either (a) the truncated return of the progressive reel slot machine, or (b) the flat return and the reset value of the jackpot. Also, the player is provided with the equations and/or means to calculate the current expected progressive return given the posted information. Depending on the posted information, the calculating means can employ one of the above equations [3], [4], or [6], or an equivalent method.

It may be desirable to combine and/or encode the information to simplify the calculation procedure and to limit availability and disclosure of the critical parameters of the machine. In this manner, unfettered disclosure of the critical parameters of the machines can be avoided, if desired. In addition, the use of the method can be limited to certain establishments and/or to "authorized" or "selected" players who are in possession of the means to calculate/decode the current progressive expected return. For example, in one embodiment, the (fixed) probability of hitting the progressive jackpot $\alpha$ can be divided by the (also fixed) amount of the qualifying bet D to produce the "m" value of equation [4]. This "m" value, and the truncated return $R_T$ can be posted on the progressive reel slot machine along with the amount of the current progressive jackpot $J_d$. Thus, a player using a calculating means employing equation [4] would be able to determine the current expected progressive return of the machine given the "m" value and the truncated return.

The probability of hitting the progressive jackpot a (expressed as a percentage) is usually much less than one hundred (usually between 0.001% and 0.1%). In addition the qualifying bet D is usually a small number (usually between 0.5 and 25). Thus the "m" value ($m=\alpha/D$) is usually a number much less than 1 which can be difficult for a player to read and/or understand, even if expressed in scientific notation. Therefore, to increase the ease of use of the method, and to simultaneously further encode the critical parameters of the machine, a symbol or a number related to the "m" value can be used in place of the actual numerical "m" value. For example, an (encoded) letter or symbol can replace the "m" value of a particular progressive reel slot machine, either of which corresponds to a letter or symbol associated with a calculating procedure or means. As an example of such encoding, the "m" value can be replaced by a number $\mu$ equal to the logarithm of the "m" value based on a small number "a",plus a constant (e.g., 50) such as:

$$\mu=\log_a(m)+50; \quad [8]$$

where a is a constant equal to, for example, $10^{1/10}$; and m is the probability of hitting the progressive jackpot $\alpha$ (expressed as a percentage) divided by the qualifying bet D.

In this manner the "m" value of a particular machine can be better represented by the "$\mu$" value, which can be an integer from, for example, 0 to 50. The truncated and flat returns of progressive reel slot machines typically vary between about 80% and 99%. Similar to the "m" value, the truncated return $R_T$ (or the flat return $R_o$) can be posted in raw form or symbolic/encoded form on the progressive reel slot machine.

The published critical parameters can be presented in encoded form by any suitable manner. For example, the encoded parameters can be presented as a continuous string such that one part of the string represents one parameter (e.g., the "m" value or flat return $R_o$) and another part of the string represents another parameter (e.g., the truncated return $R_T$ or the reset value of the jackpot $J_o$). Or, the encoding may be such that the entire string encodes, in combined form, two or more parameters of the machine. For example, two or more of the above parameters could be encoded according to a suitable encryption or encoding method into a single code, which can be decoded by a device or method designed to decode such an encryption or encoding method.

Figure 5:
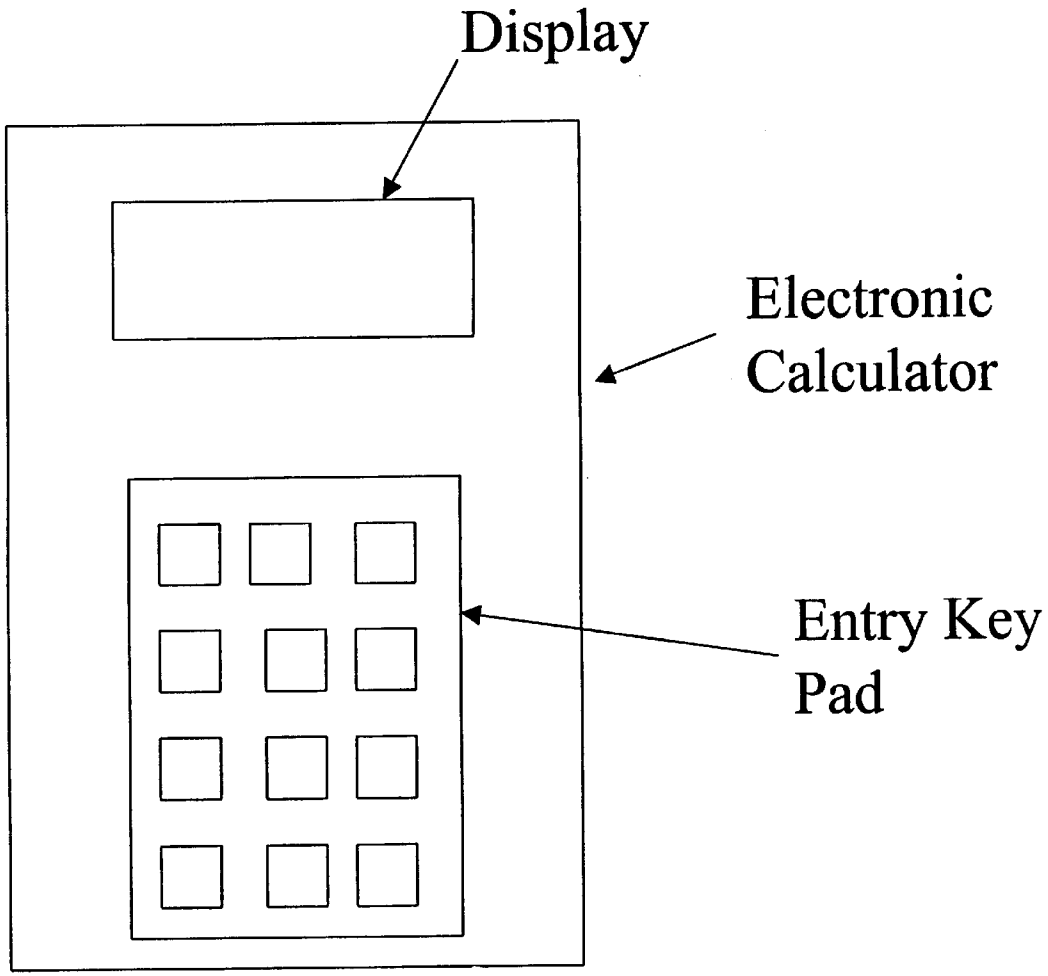
FIG. 5 is a top plan view of an electronic calculating device of the present invention.

To calculate the current expected progressive return using the posted information, the players are preferably provided with a calculating means designed to use one of the above equations (or a variation thereof). To the extent allowed by applicable gaming laws and regulations, the calculating means can be in the form of an inexpensive electronic calculating device (as showen in FIG. 5) pre-programmed with one of the above equations (or an equivalent thereof), which device is designed to accept input in the predetermined, posted form. Thus, if the critical information is posted on the individual progressive reel slot machines, the player would be required to approach the machine to read the information. He or she would then enter the information into the electronic device, which would calculate and display the current expected progressive return. Based on the number produced, the player could then choose to play the machine at that time, or decide to search for a machine with a better return. The electronic calculating device is preferably designed to be used exclusively for the purposes of determining the current expected progressive return of progressive reel slot machines. In addition, individual operators can encode the posted information and design the programming of the electronic calculator device such that a particular type of device must be used at their facilities.

Referring to FIGS. 1–4, alternatively, the calculating means can be in the form of a slide rule employing one of the above equations (or an equivalent). In one embodiment employing a version of equation [4], the slide rule has an inner card 10, a middle sleeve 12 and an outer sleeve 14. The inner card 10 includes a first column 16 of "$\mu$" values representing various "m" values $m_\mu$, which "m" values are equal to the probability of hitting the progressive jackpot ($\alpha$, expressed as a percentage), divided by the qualifying bet D. The numbers in the first column 16 are arranged in ascending sequence, equally spaced from top to bottom, with the represented values increasing in an exponential series. For example, the represented "m" value $m_\mu$ can increase according to the formula: $m_\mu=10^{-5}a^\mu$, where $m_\mu=\mu$th "m" value, $a=10^{1/10}$ and the $\mu$ values are integers from 0 to 50.

Since the "m" values are usually numbers much less than one, the "m" values can be better represented (in a more readable form) by the number $\mu$. If $m_\mu$ is chosen according to the above formula, $\mu$ can be derived from $\mu=\log_a(m_\mu)+50$, (i.e. $\mu$=0,1,2 . . . 50). For simplicity, this number $\mu$ will be referred to herein as the "$\mu$" value. This number can also be considered the line number of the represented "m" value.

The inner card 10 also includes an array (columns and rows) of numbers 18 representing the current expected return of the progressive slot machine, from the player's perspective $R_{Prog(P)}$. The array of numbers is spaced a distance away from the first column 16 of numbers and the rows of the array are aligned with the numbers in the first column 16.

The middle sleeve 12 of the device slides over the inner card 10 and contains a first (small) window 20 which is aligned with the column 16 of "$\mu$" values on the inner card, and is sized to expose only one of the "$\mu$" values at a time. Adjacent the first window 20 is a second column of numbers 22 representing various dollar amounts of the current progressive jackpot, $J_d$. One of the numbers of the second column 22 is aligned with the first window 20 and the numbers are equally spaced apart a distance equal to that between the numbers of the first column of numbers 16 and between the rows of the array 18 on the inner card 10. The numbers of the second column 22 increase from top to bottom in an exponential series, using the same base number as that for the "m" and "$\mu$" values. For example, the jackpot amounts can increase according to the formula $(J_d)_\nu=100a^\nu$, where the base number $a=10^{1/10}$, and the $\nu$ value is an integer from 0 to 50.

The middle sleeve 12 also includes a second (large) window 24 which preferably has a length and width equal to the length and width of the array of numbers 18 on the inner card 10. The second window 24 is preferably located to expose the entire array of numbers 18 on the inner card 10 when the first number of the first column 16 on the inner card 10 is aligned with the first (small) window 20 in the middle sleeve 12.

The outer sleeve 14 slides over the middle sleeve 12 and includes an elongated, longitudinally-extending window 26. The longitudinally-extending window 26 is aligned to overlap the first window 20 in the middle sleeve 12, such that the first window 20 and the number exposed therein remain visible as the inner card 10 and middle sleeve 12 slide relative to the outer sleeve 14.

The outer sleeve 14 also includes an elongated, laterally-extending window 28 which has a length equal to the distance sufficient to expose at least one row of the column of numbers 22 on the middle sleeve 12 and an entire row of numbers of the array 18 on the inner card. The laterally-extending window 28 is preferably sized to expose only one row of each of the column of numbers 22 on the middle sleeve 12 and the array 18 on the inner card 10.

The outer sleeve 14 also preferably includes indicia (i.e., $J_d$, $b_0$, $b_1$, $b_2$ . . . $b_n$), located above the laterally-extending window 28 to indicate that the numbers represent the current dollar amount of the progressive jackpot and the current expected progressive return for several preselected values of the truncated return of the progressive slot machines.

The middle sleeve 12 preferably includes a top thumb notch 30 through which a top edge 32 of the inner card 10 is exposed. The outer sleeve 14 includes both top and bottom thumb notches 34, 36. The inner card 10 is exposed through the top notch 34 of the outer sleeve, and the bottom edge 38 of the middle sleeve 12 is exposed through the bottom thumb notch 36 of the outers sleeve 14.

Figure 4:
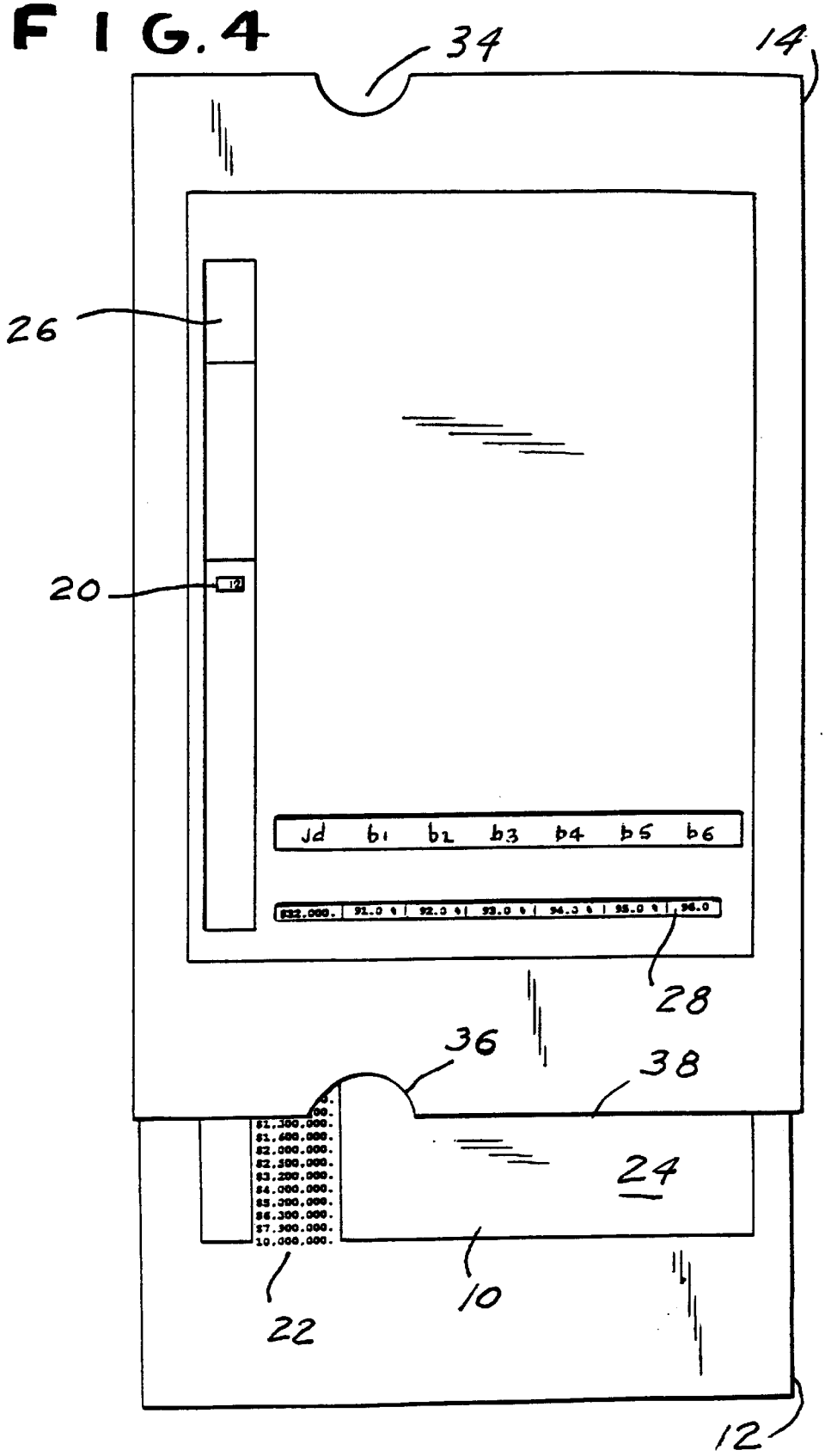
FIG. 4 is a top plan view of slide rule calculator.

Referring to FIG. 4, using the slide rule, a player would be required to approach the machine to read the displayed information. He or she would then adjust the sleeves of the slide rule to "calculate" the current expected progressive return. Based on the number produced, the player could then choose to play the machine at that time, or decide to search for a machine with a better return.

For example, the player would move the inner card 10 relative to the middle sleeve 12 such that the appropriate "m" value (e.g., "12" shown) is visible through the first window 20. To do this, the player would grasp the top edge 32 of the inner card 10 through the top thumb notch 34 and the (only) thumb notch 30 in the middle sleeve. Then the player moves the outer sleeve 14 relative to the middle sleeve 12 and the inner card 10 such that the appropriate current dollar amount of the progressive jackpot (e.g. $32,000) is visible through the laterally-extending window 28 in the outer sleeve 14. To do this, the player would grasp the bottom edge 38 of the middle sleeve through the bottom thumb notch 36 of the outer sleeve 14. Then the user reads the current expected progressive return, which appears below the label for the appropriate published truncated return of the progressive slot machine. The current expected progressive return is thus either 91.0%, 92.0%, 93.0%, 94.0%, 95.0%, or 96.0%, depending on the published truncated return of the progressive reel slot machine.

Since (a) the first row of the array 18 of expected progressive return values is aligned with the first number in the column 16 representing the "$\mu$" values, when the "$\mu$" value in the slide rule is set to the line number $\mu$ of the column of "$\mu$" values (by sliding the inner card relative to the middle sleeve), and (b) the current dollar amount of the progressive jackpot $J_d$ is set to the line number $\nu$ of the column of numbers 22 representing the current dollar amount of the progressive jackpot (by sliding the outer sleeve relative to the middle sleeve and inner card), then (c) the line number $\lambda=\mu+\nu$ of the array 18 of present expected progressive return values will appear in the laterally-extending window 28 in the outer sleeve 14. As stated above in equation [4], the expected return $R_{Prog(P)}$, from a player's perspective, of a progressive reel slot machine can be expressed as: $R_{Prog(P)}=mJd+R_T$. Thus, the array of numbers of the present expected progressive return R, at row $\lambda$, column $\kappa$, can be determined by the formula: $R_{\mu\nu\kappa}=m_\mu(J_d)_\nu+b_\kappa=10^{-3}a^{\mu+\nu}+b_\kappa$; or $R_{\lambda,\kappa}=10^{-3}a^\lambda+b_\kappa$, where $b_\kappa$=the preselected values of the truncated return of the progressive slot machine, which can be defined by $b_\kappa=86+\kappa$, the value $\kappa$ being an integer from, for example, 0 to 11.

The publishing or posting of the critical parameters, in raw or encoded form, will increase player attraction to and interaction with the progressive reel slot machines. This will enhance the entertainment value of the machines and increase gaming activity. The increase in gaming activity benefits the machine operators, which depend on such activity. The method benefits the players by providing enhanced entertainment value and the ability to choose the return received for each bet.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. A method of increasing gaming activity and entertainment value of a progressive reel slot machine, comprising:

(a) providing a progressive reel slot machine having a progressive jackpot; and (b) publishing in raw or encoded form certain critical parameters of said progressive reel slot machine, including:

(i) a probability of hitting the progressive jackpot;

(ii) an amount of a current progressive jackpot;

(iii) an amount of a qualifying bet required to qualify for the progressive jackpot; and (iv) either:

(A) a truncated return of the progressive reel slot machine; or (B) the flat return of the progressive reel slot machine and a minimum reset amount of the progressive jackpot.

2. A method as in claim 1, further comprising either:

(a) providing means to calculate a current progressive expected return of the progressive reel slot machine given the published critical parameters; or (b) publishing an equation to calculate the current progressive expected return of the progressive reel slot machine given the published critical parameters.

3. A method as in claim 2, wherein:

(a) two or more of said published critical parameters are presented as a continuous string, wherein one part of said string represents one parameter and another part of the string represents another parameter; and (b) said calculating means or said published equation is designed to decode said string.

4. A method as in claim 2, wherein:

(a) two or more of said published critical parameters are encoded in combined form, wherein all portions of the code incorporate the encoded parameters; and (b) said calculating means or said published equation is designed to decode said string.

5. A method as in claim 2, wherein said means to calculate the current expected progressive return of the progressive reel slot machine comprises a slide rule designed to calculate the current expected progressive return for various progressive reel slot machines upon input of the published critical parameters.

6. A method as in claim 5, wherein said slide rule comprises:

(a) a card member, a middle sleeve and an outer sleeve;

(b) the card member having a first column of symbols representing various values of probabilities of hitting the progressive jackpot for various progressive reel slot machines, which probabilities increase as an exponential function of a base number, and having an array of symbols representing various values of the current expected progressive return of the various progressive reel slot machines, said array having at least one array column and having rows aligned with said symbols of said first column;

(c) said middle sleeve being slidable over said card member and having a first window located over said first column of symbols, said first window being sized and shaped to expose one of said symbols of said first column;

(d) said middle sleeve having a second column of symbols representing various dollar amounts of the current progressive jackpot, which dollar amounts increase as an exponential function of said base number, said symbols of said second column being spaced apart a distance equal to a distance between said rows of said array such that said symbols of said second column are alignable with said rows of said array;

(e) said middle sleeve having a second window located over said array, said second window extending at least from a top of said second column of symbols to a bottom thereof and having a width sufficient to expose all of said array columns;

(f) said outer sleeve being slidable over said middle sleeve, having a longitudinal axis and a lateral axis, and having an elongated, longitudinally-extending window located to expose said first window in said middle sleeve and any symbol of said first column of symbols visible therethrough, said longitudinally-extending window having a length substantially equal to a distance from said top of said second column to said bottom thereof;

(g) said outer sleeve having a laterally-extending window located to expose one of said symbols of said second column on said middle sleeve and an aligned row of said array on said card member;

(h) said outer sleeve having indicia associated with array columns visible through said laterally-extending window, said indicia representing various values of the truncated return of progressive slot machines; and (i) the values of the current expected progressive return represented by said array of symbols being determined by an exponential function of said base number plus a number representing the truncated return of the various progressive slot machines, each column of said array representing a different value of the truncated return;

whereby the current expected progressive return of the progressive slot machine at a particular point in time can be obtained with the slide calculator by sliding the card member relative to said middle sleeve such that a symbol from said first column representing the probability of hitting the progressive jackpot of the progressive reel slot machine is visible through said first window, and then sliding said outer sleeve relative to said middle sleeve and said card member such that a symbol from said second column representing the current dollar amount of the progressive jackpot of the progressive slot machine is visible through said laterally-extending window, and then reading the value of the present expected progressive return for the progressive slot machine, which value is associated with said indicia representing the truncated return of the progressive slot machine.

7. A method as in claim 5, wherein said slide rule comprises:

(a) a card member having a first column of symbols representing various values of probabilities of hitting the progressive jackpot for various progressive reel slot machines, which probabilities increase as an exponential function of a base number, and having an array of symbols representing various values of the current expected progressive return of the various progressive reel slot machines, said array having at least one array column and having rows aligned with said symbols of said first column;

(b) a middle sleeve slidable over said card member, having a first window located over said first column of symbols, and having a second window located over said array;

(c) said middle sleeve having a second column of symbols representing various dollar amounts of the current progressive jackpot, which dollar amounts increase as an exponential function of said base number;

(d) an outer sleeve slidable over said middle sleeve, and having a third window located to expose said first window in said middle sleeve and any symbol of said first column of symbols visible therethrough;

(e) said outer sleeve having a fourth window located to expose at least one of said symbols of said second column on said middle sleeve and an aligned row of said array on said card member; and (f) said outer sleeve having indicia associated with array columns visible through said fourth window.

8. A method as in claim 2, further comprising inputting the published critical parameters into an electronic calculating device to display the current expected return upon input of the published critical parameters.

9. A method as in claim 2, wherein the probability of hitting the progressive jackpot and the qualifying bet are presented in combined form by publishing a number or symbol representing the probability of hitting the progressive jackpot divided by the amount of the qualifying bet.

10. A method as in claim 9, wherein the truncated return, or the flat return is represented in a non-numeric, symbolic form.

11. A method as in claim 1, wherein two or more of said published critical parameters are presented as a continuous string, wherein one part of said string represents one parameter and another part of the string represents another parameter.

12. A method as in claim 1, wherein two or more of said published critical parameters are encoded in combined form, wherein all portions of the code incorporate the encoded parameters.

13. A method as in claim 1, wherein said step of publishing said critical parameters comprises posting said critical parameters on or adjacent to said progressive reel slot machine such that a player is required to approach said machine to read said critical parameters.

14. A method as in claim 1 wherein the step of publishing said critical parameters comprises publishing the truncated return of the progressive reel slot machine.

15. A method as in claim 14, wherein the step of publishing said critical parameters comprises posting said critical parameters on said progressive reel slot machine such that a player is required to approach said machine to read said critical parameters.

16. A method as in claim 1 wherein said step of publishing said critical parameters comprises publishing the flat return of the progressive reel slot machine and the minimum reset amount of the progressive jackpot.

17. A method as in claim 16, wherein the step of publishing said critical parameters comprises posting said critical parameters on said progressive reel slot machine such that a player is required to approach said machine to read said critical parameters.

18. A slide rule calculator for determining the current expected progressive return of various progressive reel slot machines, each having a current dollar amount of the progressive jackpot, a probability of hitting the progressive jackpot, and a truncated return, the slide calculator comprising:

(a) a card member having a first column of symbols representing various values of probabilities of hitting the progressive jackpot for various progressive reel slot machines, which probabilities increase as an exponential function of a base number, and having an array of symbols representing various values of the current expected progressive return of the various progressive reel slot machines, said array having at least one array column and having rows aligned with said symbols of said first column;

(b) a middle sleeve slidable over said card member, having a first window located over said first column of symbols, and having a second window located over said array;

(c) said middle sleeve having a second column of symbols representing various dollar amounts of the current progressive jackpot, which dollar amounts increase as an exponential function of said base number;

(d) an outer sleeve slidable over said middle sleeve, and having a third window located to expose said first window in said middle sleeve and any symbol of said first column of symbols visible therethrough;

(e) said outer sleeve having a fourth window located to expose at least one of said symbols of said second column on said middle sleeve and an aligned row of said array on said card member; and (f) said outer sleeve having indicia associated with array columns visible through said fourth window.

19. A slide rule calculator for determining the current expected progressive return of various progressive reel slot machines, each having a current dollar amount of the progressive jackpot, a probability of hitting the progressive jackpot, and a truncated return, the slide calculator comprising:

(a) a card member, a middle sleeve and an outer sleeve;

(b) the card member having a first column of symbols representing various values of probabilities of hitting the progressive jackpot for the various progressive reel slot machines, which probabilities increase as an exponential function of a base number, and having an array of symbols representing various values of the current expected progressive return of the various progressive slot machines, said array having at least one array column and having rows aligned with said symbols of said first column;

(c) said middle sleeve being slidable over said card member and having a first window located over said first column of symbols, said first window being sized and shaped to expose one of said symbols of said first column;

(d) said middle sleeve having a second column of symbols representing various dollar amounts of the current progressive jackpot, which dollar amounts increase as an exponential function of said base number, said symbols of said second column being spaced apart a distance equal to a distance between said rows of said array such that said symbols of said second column are alignable with said rows of said array;

(e) said middle sleeve having a second window located over said array, said second window extending at least from a top of said second column of symbols to a bottom thereof and having a width sufficient to expose all of said array columns;

(f) said outer sleeve being slidable over said middle sleeve, having a longitudinal axis and a lateral axis, and having an elongated, longitudinally-extending window located to expose said first window in said middle sleeve and any symbol of said first column of symbols visible therethrough, said longitudinally-extending window having a length substantially equal to a distance from said top of said second column to said bottom thereof;

(g) said outer sleeve having a laterally-extending window located to expose one of said symbols of said second column on said middle sleeve and an aligned row of said array on said card member;

(h) said outer sleeve having indicia associated with array columns visible through said laterally-extending window, said indicia representing various values of truncated return of progressive slot machines; and (i) the values of the current expected progressive return represented by said array of symbols being determined by an exponential function of said base number plus a number representing truncated return of progressive slot machines, each column of said array representing a different value of truncated return;

(j) whereby the current expected progressive return of a certain progressive slot machine at a particular point in time can be obtained with the slide calculator by sliding the card member relative to said middle sleeve such that a symbol from said first column representing the probability of hitting the progressive jackpot of the certain progressive slot machine is visible through said first window, and then sliding said outer sleeve relative to said middle sleeve and said card member such that a symbol from said second column representing the current dollar amount of the progressive jackpot of the certain progressive slot machine is visible through said laterally-extending window, and then reading the value of the present expected progressive return for the progressive slot machine, which value is associated with said indicia representing the truncated return of the certain progressive slot machine.

* * * * *